United States Patent [19]

Wilkinson et al.

[11] Patent Number: 4,561,267

[45] Date of Patent: Dec. 31, 1985

[54] KNITTED SOCK

[75] Inventors: Maxwell Wilkinson, Sandringham; Malcolm J. Patten, Ringwood; Jeffrey H. Lee, Box Hill North, all of Australia

[73] Assignee: Dunlop Olympics Limited, Brunswick, Australia

[21] Appl. No.: 173,712

[22] Filed: Jul. 30, 1980

Related U.S. Application Data

[63] Continuation-in-part of Ser. No. 904,380, May 10, 1978, and Ser. No. 38,887, Jul. 29, 1980.

[30] Foreign Application Priority Data

May 10, 1977 [AU] Australia ..... PD 0048/77

[51] Int. Cl.[4] ..... D04B 11/00

[52] U.S. Cl. ..... 66/178 A; 66/172 E

[58] Field of Search ..... 66/172 E, 178 A, 202, 66/183, 172 B, 146

[56] References Cited

U.S. PATENT DOCUMENTS

| | | | |
|---|---|---|---|
| Re. 25,046 | 10/1961 | Kohl | 66/178 A |
| 1,659,934 | 2/1928 | Willmott | 66/178 A |
| 2,441,443 | 5/1948 | Reed | 66/183 |
| 2,474,494 | 7/1949 | Gottschaler | 66/183 |
| 3,230,092 | 5/1966 | York et al. | 66/178 X |
| 3,386,270 | 6/1968 | Simmons | 66/183 X |
| 3,392,553 | 7/1968 | Burleson | 66/178 A |
| 3,889,494 | 6/1973 | Patience et al. | 66/178 A X |
| 4,027,667 | 6/1977 | Swallow | 66/172 E |
| 4,027,667 | 6/1977 | Swallow et al. | 66/178 A S |
| 4,048,818 | 9/1977 | Cueman | 66/178 A |
| 4,086,790 | 5/1978 | Hanrahan et al. | 66/178 A |
| 4,172,456 | 10/1979 | Zens | 66/178 A |
| 4,180,065 | 12/1979 | Bowen | 66/172 E |

FOREIGN PATENT DOCUMENTS

| | | | |
|---|---|---|---|
| 529186 | 6/1954 | Belgium | 66/178 A |

*Primary Examiner*—Ronald Feldbaum
*Attorney, Agent, or Firm*—Fred Philpitt

[57] ABSTRACT

A knitted sock of a length not extending above the knee of the wearer and of a fabric having less than about 105 stitches per square centimeter, the fabric of the sock having an elastic character that varies progressively from the ankle area to the top marginal area in a manner so that the fabric-to-leg pressure at the mid-calf is less than 60% of the pressure at the area of minimum leg circumference.

8 Claims, 4 Drawing Figures

KNITTED SOCK

This application is a continuation-in-part of Ser. No. 904,380 filed May 10, 1978 and Ser. No. 38,887 filed July 29, 1980.

This invention is concerned with knitted hosiery for men, women and children. The invention is directed specifically to hoisery that does not extend above the knee of the wearer, and referred to as socks. In particular, but not exclusively, the invention relates to socks having a leg length not extending above the mid-calf part of the human leg when in normal position (position of minimum energy) during wear. Included in this category of socks are items known as "short socks", "ankle socks", "anklets", "half hose", "crew socks", "below-the-calf socks", "mid-calf socks". However the invention also relates to socks that extend close to the wearer's knee and sometimes referred to as "executive length socks", "knee high socks" or "walk socks".

Hereinafter the term "socks" will mean knitted garments for clothing the foot and leg that do not extend above the knee of the wearer when in the normal wearing position and composed of a fabric having less than about 105 stitches per square centimeter (700 stitches per square inch) when measured fully stretched in course and wale directions and at standard conditions for testing textiles.

In the period, prior to approximately 1935, socks, as distinct from stockings which reached over the knee, were chiefly of a length reaching to the wearer's knee, or else to the mid-calf part of the wearer's leg, the latter being known as "half-hose". In order to restrain the leg of the knee length socks from slipping down a wearer's leg whilst walking, circular garters generally made from rubber elastic braid were used. The leg of the half-hose type of sock was restrained from slipping by suspenders, attached to the wearer's leg between the knee and calf muscle, and clipped to the top of the leg of the sock.

Approximately forty to fifty years ago technology was developed for the laying of rubber elastic thread into the stitches of knitted fabric, and this technology was used to produce socks with such thread laid into a number of knitted courses at the top of the leg of socks. The thread so laid into the knitted fabric constituted an elastic band at the top portion of a sock leg, and in reference to it the term "elastic top" is commonly used.

The purpose of the elastic top was the incorporation within the sock of means of restraining the leg portion from slipping down a wearer's leg during walking, thus eliminating the need to have extraneous means of restraint as described above. The elastic top in a below-the-calf sock is stretched when initially placed on the leg and thus grips the leg of a wearer. After a period of wearing, during which the wearer walks with a normal gait and velocity of leg, it is usual for a sock to progressively slip down the wearer's leg, forming wrinkles in the fabric of the lower part of the leg of the sock. This slippage commonly occurs even when the elastic top exerts pressure on the leg of such magnitude as to cause temporary skin indentation and irritation.

It is the purpose of the present invention to provide socks, particularly those with leg length not extending above the mid-calf position of wearer's legs, and which exhibit superior resistance to slipping down wearer's legs during walking also causing minimal and generally negligible skin indentation or skin irritation.

It is recognized that the part of the human leg, from the location of mid-calf to the location of minimum circumference, is approximately the shape of an inverted truncated cone. When a sock is drawn on to the leg of a wearer and located in a normal position for wear, the fabric of the leg portion of the sock usually exerts a pressure on the leg of the wearer and this sock-to-leg pressure will generally vary according to position between the two locations referred to above. The pressures are exerted as a consequence of the varying circumferential extensions giving rise to varying circumferential tensions within the fabric of the leg of a sock.

At any one place between the two locations indicated above (mid-calf and minimum leg circumference), the force exerted by the fabric on to the leg in a circumferential plane is, by virtue of the shape of the leg, not normal to the leg surface. It may, therefore, be resolved into two components, one being normal to the leg surface and the other one downwards along the leg surface, a fact to which reference is made hereinafter.

When a sock is first donned by a wearer, and the top margin pulled some distance up the leg, its leg fabric is usually in a stretched state through tension being applied in the action. The individual stitches are in an elongated and stretched condition. When the wearer starts to flex a leg and move it gently the stretched stitches will change from their elongated to a more rounded form. This form approximates to an equilibrium position for a leg in gentle movement.

When the wearer commences prolonged walking whether continuous or intermittent, two main groups of forces are acting on the leg fabric. In the first group are those which favour slipping of the leg fabric down the wearer's leg accompanied by wrinkling (or buckling) of the fabric, while in the second group are those forces which resist slipping and wrinkling of the leg fabric.

For a leg involved in the motion of walking the chief pro-slip forces are:

(a) That component of the force exerted by the leg fabric acting downwards along the surface of the leg, (b) That component of the gravitational force acting on the mass of the leg fabric parallel to the surface of the leg, (c) That component of the force resulting from the momentum of the sock fabric, the velocity of which changes each time the wearer's foot touches the ground.

The chief contra-slip forces are:

(d) That resulting from the friction between the leg fabric and the skin of the wearer, (e) That arising from the fabric below any portion which is tending to slip and which is due to resistance to displacement as regards location that is, slipping downwards, or to configuration, that is, to wrinkling.

If the sum of the forces "a", "b" and "c" is greater than the sum of the forces "d" and "e" in any portion of the leg fabric then conditions exist for the fabric to slip down the leg. This slipping will continue until conditions change to make the sums of the two groups of forces equal at which stage further slipping and wrinkling do not occur.

In constructing a sock in which the leg fabric will not slip down the leg from the position of equilibrium described above, it is necessary to ensure that the sum of the forces "a", "b" and "c" is less than the sum of the forces "d" and "e" by minimizing the magnitude of the pro-slip forces and maximizing the magnitude of the contra-slip forces.

It has been discovered that by varying in a selected manner these circumferential tensions of the leg fabric of the socks and accordingly the fabric-to-leg pressure, there can result socks in which the leg portion resist slipping down the wearer's legs during walking.

In the preferred construction of the sock the fabric-to-leg pressure progressively decreases from the location of minimum leg circumference to the mid-calf location at a rate so that the fabric-to-leg pressure at the mid-calf is less than 60% of the value at the minimum leg circumference.

Conveniently, the decrease in the fabric-to-leg pressure at the mid-calf is between 5% to 60% of that at the location of minimum leg circumference, and preferably between 20% to 40%.

When the invention is applied to a sock that does not extend to the mid-calf the minimum percentage decrease in the fabric-to-leg pressure from the value at the minimum leg circumference to the top marginal portion is 40% multiplied by the ratio of the distance from the minimum leg circumference to the marginal top of the sock to the distance from the minimum leg circumference to the mid-calf.

It has been found that a leg fabric which resists slipping down a wearer's leg can be constructed initially by providing a portion of fabric around the place where the leg has minimum circumference and extending it down to the ankle joint.

This portion of fabric has moderate to high circumferential tension whilst on the leg and, therefore, moderate to high fabric-to-leg pressure. Then there is required a decreasing of the circumferential tension and fabric-to-leg pressure at a selected and relatively rapid rate whilst proceeding from the region of minimum leg circumference to the top margin of the sock.

The ability of a sock of such construction to resist slipping down the leg of a wearer may be explained by considering the leg of the sock as a series of bands of fabric (as illustrated in FIG. 4).

The portion of fabric at the minimum leg circumference (band 1) and extending down to the ankle joint is located on an approximately conical shaped section of the wearer's leg and, therefore, the circumferential fabric tension has a force component 'parallel' to the leg surface tending to push the fabric upwards. Thus the position of fabric at the minimum leg circumference possesses an added ability to resist displacement downwards. Frictional resistance is also present.

For the narrow band of fabric (2) in FIG. 1 to be able to slip downwards, it must either displace downwards the fabric band (1) or cause this band to form a wrinkled or buckled section (x), fabric band (1) resists slipping downwards as already explained.

It should be noted that the action of the leg fabric of a sock becoming wrinkled involves an increase in fabric circumference and, therefore, an increase in circumferential tension in the wrinkled fabric. Thus incipient buckling or micro-wrinkling, should it occur, will contribute to the contra-slip forces to resist slippage of band (2). This contributed force would act upwards from the wrinkle, in the leg fabric and parallel to the surface of the wearer's leg. It has been found that with suitably selected values for circumferential tension in bands (1) and (2), no slipping or wrinkling of fabric occurs in wearing and walking.

In a similar way the possibility of fabric band (3) slipping and causing band (2) to slip or wrinkle can be considered. With optimum selected values of the circumferential tension in the respective bands, no slipping or wrinkling will occur. The whole of the leg fabric can be considered in this way and found to be free from slipping and wrinkling.

The practice of using slowly varying fabric-to-leg pressures has been employed in surgical or thereapeutic hosiery, "leg-support" or "support" stockings, pantyhose and socks. All these articles are designed with concern for the blood circulation in the human leg and from the recommended pressure differentials between minimum leg circumference and other locations up the leg, it can be calculated that the principle applying in the more effective articles is for the circumferential tension in the leg fabric of the article on a wearer's leg to remain substantially and approximately constant over the whole leg.

Examples of such an article of therapeutic hosiery are described in various United States Patents which state that the compressive force is substantially uniform throughout the length of the article when in use.

In regard to the desirability of a uniform compressive or constrictive force in therapeutic hosiery we would refer in particular to U.S. Pat. No. 2,441,443 Col 5 lines 35 to 44, and U.S. Pat. No. 3,386,270 Col 1 lines 27 to 59.

In other therapeutic or support hosiery there has been proposed variations in the fabric-to-leg pressure along the length of the leg, such as in U.S. Pat. No. 3,889,494, however there is no suggestion that the full length stocking described has stay-up characteristics. Further as there is a substantial reduction in fabric-to-leg pressure in the knee area, the portion of the stocking above the knee would not be non-slipping in the manner proposed by the present invention. It should also be noted that in the area of the leg immediately above the knee there is a progressive increase in fabric-to-leg pressure while the leg in this area is progressively increasing in diameter. These two facts have a cumulative effect promoting downward slipping of the stocking.

The use of progressively increasing horizontal contriction in the welt of a stocking is proposed in U.S. Pat. No. 3,392,553 which is stated to be applicable to both above the knee and below the knee stockings or socks. However the purpose of the variation in the constriction is stated to be to achieve "uniform or equal compressive force against all areas of contact with the wearer's leg". This is contrary to the present invention and would not achieve the non-slip property in the manner of the present invention. Also it must be noted that it is only proposed for the variation in constriction to exist in the weld of the stocking or sock which is then merely an elasticized top type stocking or sock.

In order to characterize the socks of the present invention, and to differentiate them from surgical and therapeutic hosiery, and also from socks with elastic tops and those with constant course lengths of yarn in the portion up to the calf, and support socks tests for fabric pressure have been made.

Due to the novelty of the concept of the type of sock of the present invention there is no widely recognized or standard testing apparatus and method for fabric-to-leg pressure exerted by socks. It has therefore been necessary to choose an apparatus, adapt it for use with socks and develop a test method.

Of the two widely recognized testing instruments and methods for leg support hosiery namely "Support Hosiery Testing Apparatus and Method", U.S. Pat. No. 3,975,956 invented by Robert Peel and assigned to National Association of Hosiery Manufacturers Inc., Charlotte, N.C., U.S.A. and the "Hatra Hose Pressure Tester", developed by Hosiery and Allied Trades Research Association, Nottingham, England and manufactured by Shirley Developments Ltd., Manchester, England, both based on the same principle but differing in design, the latter was selected merely because it was more readily adaptable to the testing of socks. It provides a measure of circumferential fabric tension which can be converted to fabric-to-leg pressure for leg locations having varying radii of curvature.

The adaptation of the Hatra Hose Pressure Tester involves replacing the woman's foot portion by appropriately larger ones for mens' socks and appropriately smaller ones for children's socks then extending the suspender clips from the locations existing for hosiery of which the legs extend above a wearer's calf, so as to be able to secure during test various socks with legs which extend to locations below a wearer's calf. Additional modification for testing children's socks involves replacement of the fixed and removable arms by ones with smaller cross section.

Figure 1:
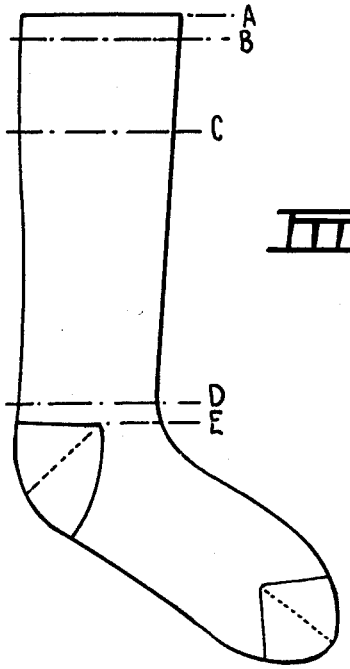
FIGS. 1-3 illustrates various embodiments of the invention.

For purposes of specification of socks of the present invention and control of quality in manufacture various appropriate settings of the Hose Pressure Tester have been adopted. For men's socks designed to fit wearers of socks sizes 10 to 12 inclusive (foot length 10 inches to 12 inches or 25 cm to 30 cm corresponding to shoe sizes 6 to 10, Australian shoe sizes 6 to 10 correspond to American sock sizes 10 to 13, inclusive—refer Australian Standard 1923-1976) the setting adopted was the "M" position of the movable arm. When a sock is pulled on to the "V" formed by the fixed and movable arms, it assumes the appropriate configuration that it would have on the leg of male wearer whose leg dimensions are the average for the population within this sock size range.

Since the "M" position is the one designated for women's surgical, therapeutic and support stockings and pantyhose comparison and contrast can be made between the pressure generated by these hosiery items at various locations on the leg and by the socks of the present invention.

Furthermore, since circumferential lengths for the average leg in various populations requiring the one sock size (men, women or children) can be closely matched on the Hatra Hose Pressure Tester (in original or modified form) figures for fabric-to-leg pressures on average legs are considered to closely approximate to those obtained by use of the Tester.

The purpose of Table I is to indicate the fabric-to-leg pressures applicable to all socks of the present invention and contrast these with pressure figures indicated in two prior United States Patents, a recognized quality standard, a recommended quality standard and also with pressure figures which are typical of three types of men's socks of conventional type.

It is seen that socks of the present invention differ markedly and, therefore, belong to a different class of garment to conventional socks and to surgical, therapeutic and leg-support hosiery and support socks and are characterized by a much greater decrease of fabric-to-leg pressure from the location of minimum leg circumference to mid-calf.

TABLE I

| | Surgical, therapeutic & leg-support hosiery | | | | Men's Conventional Type of Sock | | | Sock |
|---|---|---|---|---|---|---|---|---|
| LOCATION | Ref. 1 | Ref. 2 | Ref. 3 | Ref. 4 | No Elastic Top | With Elastic Top | Whole Leg Elasticized | of present invention |
| Minimum leg Circumference | 100% | 100% | 100% | 100% | 100% | 100% | 100% | 100% |
| 75 mm below Mid-Calf | — | — | — | — | — | 150%-250% (elastic top) | — | 5%-75% (preferably 20%-45%) |
| Mid-Calf | 95% | — | 75% | 69% | 150%-200% | — | 100%-130% | 5%-60% (preferably 20%-40%) |
| Knee | — | 70% | — | — | — | — | — | — |
| Lower Thigh | 90% | 50% | — | — | — | — | — | — |
| Mid Thigh | — | — | 50% | — | — | — | — | — |
| Upper Thigh | — | 40% | — | — | — | — | — | — |

Figures in each column are fabric-to-leg pressures expressed as a percentage of the pressure at the minimum leg circumference of each item.

Ref. 1 USP Re 25,046 Oct 3 1961. Example III: Pressure in ankle 20 mm of mercury, in calf 19 mm and in lower thigh 18 mm.

Ref. 2 Technical Production Guidelines for Two-Way Stretch Surgical Stockings with the Quality Mark. (Quality Mark Association for Surgical Elastic Stockings, Hohenstein, W. Germany, 1972).

Ref. 3 Levels acceptable for therapeutic value: (Consumer Bulletin Sept., 1972, pages 32-35, Consumers Research Inc., Washington, U.S.A.).

Ref. 4 USP 3,386,270 June 4 1968. From this statement in this patent that the compressive force on the ankle (minimum leg circumference) may be the same as on the remaining portions of the leg, it can be deduced that for a minimum leg circumference of 24 cm and a mid-calf circumference of 35 cm which the average figures for men wearing sock size 6-10 (Australian) that the ratio of fabric-to-leg pressures at the two positions is 100 to 69.

As previously referred to in the case of socks of the present invention of which the of the legs is such that the marginal portion of the sock reaches a point below the mid-calf of wearer's legs when the fabric is in the normal position of wear, the percentage figure for the minimum decrease of fabric-to-leg pressure from the minimum leg circumference to the top marginal location will be the same proportion of 40% as the distance between the minimum leg circumference and top margin of the sock is to the distance between the minimum leg circumference and the location of the mid-calf circumference.

Table II illustrates this case.

TABLE II

| Location | Mens' socks with top margin of leg below mid-calf of wearers — Fabric to Leg Pressure: Actual Percentage | Decrease from Value at Minimum Leg Circumference |
|---|---|---|
| Minimum Leg | 100% | — |
| Top margin when located at distances above minimum leg circumference as follows- | | |
| 60 mm | 89% maximum | 11% minimum |
| 90 mm | 84% maximum | 15% minimum |
| 120 mm | 78% maximum | 22% minimum |
| 150 mm | 72% maximum | 28% minimum |
| 180 mm | 66% maximum | 34% minimum |
| Mid-Calf | 60% maximum | 40% minimum |

While it has been stated that this invention is particularly applicable to socks having a leg length not extending above the mid-calf part of the human leg when in the normal position of wear, nevertheless, it is applicable to socks which extend above the mid-calf, for example knee-length socks.

Socks having a leg length extending above the mid-calf are characterized by a decrease in fabric to leg pressure at mid-calf of at least 60% from the figure for fabric-to-leg pressure at the minimum circumference position, with fabric-to-leg pressure at the minimum circumference position, with fabric-to-leg pressure in locations from mid-calf to the top margin are not critical. Owing to the resistance to slipping exhibited by the leg fabric below the mid-calf, the circumferential fabric tension and fabric-to-leg pressure in the leg portion between mid-calf and knee will not need to be as great as required in knee length socks of conventional construction, and thus the socks in addition will produce enhanced personal comfort.

While the actual fabric-to-leg pressure at the minimum leg circumference may be relatively high even up to 50 mm mercury, preferred ranges are minimum leg circumference about 8 to 16 mm mercury, mid-calf circumference about 2 to 6 mm mercury.

As it has been recognised that friction between sock fabric and the wearer's skin helps the sock to resist slipping down the leg as a result of walking, then it follows that fabric-to-leg pressures must be adequate to give rise to some useful frictional force even in the upper parts of the leg of the sock where the fabric tensions may be relatively low.

It is common practice to design a sock to fit a range of one or more foot sizes. Such foot sizes may be designated by shoe size or by foot length according to the system used. Within any range of one or more foot sizes, the contours of the feet and legs of the population of wearers vary and in this particular case, those portions of legs located below the knee. The one design of sock is, nevertheless, expected to fit not only wearers' feet of varying dimensions but also wearers' legs of varying dimensions. Socks with the characteristics of this invention can exhibit resistance to slipping down wearers' legs and minimal or negligible skin indentation or skin irritation for a high percentage of any population of wearers and for selected values of sock characteristics this percentage will exceed 90%.

The performance in wear exhibited by the socks of the present invention differs noticeably, therefore, from that of mid-calf and below the calf socks having the prior known elastic tops. In these latter types of percentage of population which finds resistance to slipping down the leg during walking together with freedom from skin indentation and skin irritation may be as low as 10%. The production of socks with legs not extending above the mid-calf, without discrete elastic tops, but with an elastic yarn knitted or laid into the whole length of the leg fabric with constant yarn length per course does not greatly increase the percentage of a population of wearers with socks which resist slipping down their legs during walking.

The required fabric-to-leg pressure of the sock may be achieved by incorporating elastic threads into the fabric of the sock. These threads may be made either wholly or partly of elastomeric material and/or textured or otherwise processed polymeric filament or fibre imparting elastic quality to the thread.

The variation in the pressure may be achieved by varying the quantity of elastic thread or by varying the tension in the thread during the actual incorporation thereof into the fabric. The variation in tension may be obtained by variation in the form or size of stitch used.

The behaviour of the socks in resisting slippage down the leg as a result of walking is assisted by a relatively high fabric-to-leg friction, such as can be obtained with the use of spun yarns in the knitted fabric, and particularly but not necessarily, spun yarns containing wool or cotton.

A suitable knitting machine for production of a sock according to the present invention is one in which there is the capability of altering the length of all or some of the yarns fed (knitted or laid) into the knitting needles at each knitted course or at pre-determined intervals during the knitting of the leg of the sock and/or varying the feed pattern for yarns. As an example of the second alternative a particular yarn may be fed into the needles at every course, every second course, or not at all (varying the yarn course density).

Knitting machines may have cylinders varying in diameter from approximately 2¼ inches (6 cm) to approximately 6 inches (15.2 cm) and may have a number of needles varying from 36 to 280.

Fabric construction may be plain knit (also known as single jersey), rib knit or jacquard knit.

Sock construction may include a heel pocket knitted by a reciprocating action, or it may be of a "tube" type without such heel pocket and with or without yarn knitted or laid into the tube fabric to form a heel patch. Knitting yarns employed in the production of the sock may be any of those commonly used in the present art. Such yarns may be spun from the following fibres: cotton, wool, acrylic, polyamide, polyester, regenerated cellulose or may be continuous filament yarns of the following types: polyamide, polyester, regenerated cellulose, spandex (segmented polyurethane), rubber (natural or synthetic). In addition knitting may be performed from any mixtures of any two or more of any of the above mentioned fibres or continuous filaments in the form of blended mixtures, twisted mixtures or as core-spun yarns or wrapped fibres or filament yarns.

This invention particularly concerns the leg portion of the sock, the knitting of the leg and the setting of the leg fabric.

After completion of the knitting of the leg of the sock, the knitting of the heel, foot and toe is performed according to the chosen design of sock, and according to known art. Following completion of knitting the toe opening (if present) is closed by any of the present available means.

It is an optional current practice to place a sock, if it contains some fibre which can be plasticized by heat and steam on a flat metal former of a shape a little larger than that of the sock in a flat relaxed state. Socks fitted to former are placed in an autoclave and subjected to steam pressure, or in other vessels and subjected to heat, in order to achieve a moulding and setting of the sock fabric and thus a certain shape to the sock. Depending on whether this is done before or after scouring and dyeing it is known as pre-boarding or post-boarding respectively.

In order to assist in the practical application of the present invention examples of construction of sock will now be described with reference to FIGS. 1, 2 and 3 of the accompanying drawings. The socks in the examples are intended for fitting the Australian adult male population, the leg and foot characteristics of which are similar to those of many other nationalities. To fit nationalities with different foot and leg characteristics small modifications may be required but the same principle relating to the rate of decrease of fabric circumferential tension and fabric-to-leg pressure from minimum leg circumference to the top margin of the sock will apply.

EXAMPLE 1

The sock shown in FIG. 1 is knitted on an Esta, Model JU3 knitting machine fitted with a cylinder of 4 inches diameter and having 176 needles. The sock has in the leg portion between lines A and E a jacquard fabric construction.

Details of yarn and characteristics of the fabric in the respective sections of the leg of the sock (fitting men with foot length 10 to 12 inches inclusive or 25 to 30 cm corresponding to shoe sizes 6 to 10 inclusive) are shown in the following table.

| Leg Portion of sock (FIG. 1) | Yarns | No. of Courses of Knitting | Stitch Size (mm) | No. of courses of Spandex | Length of Spandex (mm) per Course |
|---|---|---|---|---|---|
| A-B | back feed: 2/110 dtex stretch nylon | 10 | 6.9 (nylon) | 0 | 0 |
| B-C | back feed: as above 37 tex cotton back feed: as above | 52 | 7.3 (cotton) | 0 | 0 |
| C-D | front feed: as above inlay:156 dtex spandex, double wrapped | 192 | as above | 91 | 145 |
| D-E | back feed: 2/110 dtex stretch nylon front feed: 37 tex cotton | 6 | 6.9 (nylon) 7.3 (cotton) | 0 | 0 |

This construction results in a stepwise decrease in the fabric to leg pressure in the sock when proceeding from portion of minimum leg circumference to the upper marginal portion of the sock. This sock provides comfortable fit without skin irritation and will resist slipping down the leg of 80% of that population of wearers for which it was designed.

EXAMPLE 2

Figure 2:
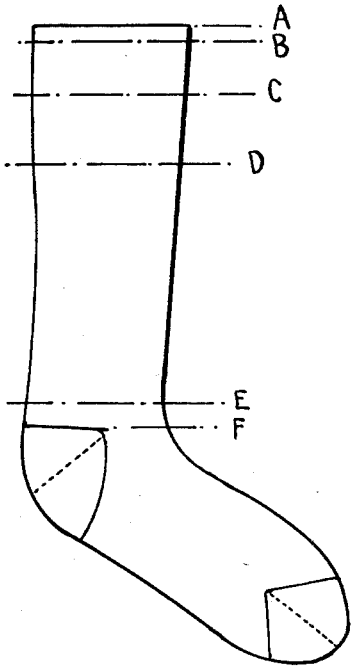
Figure 3:
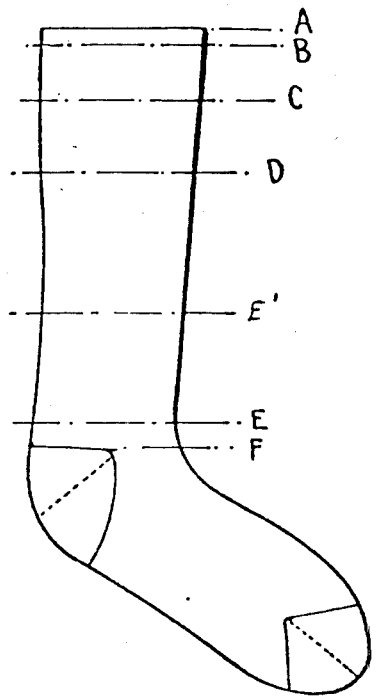
Figure 4:
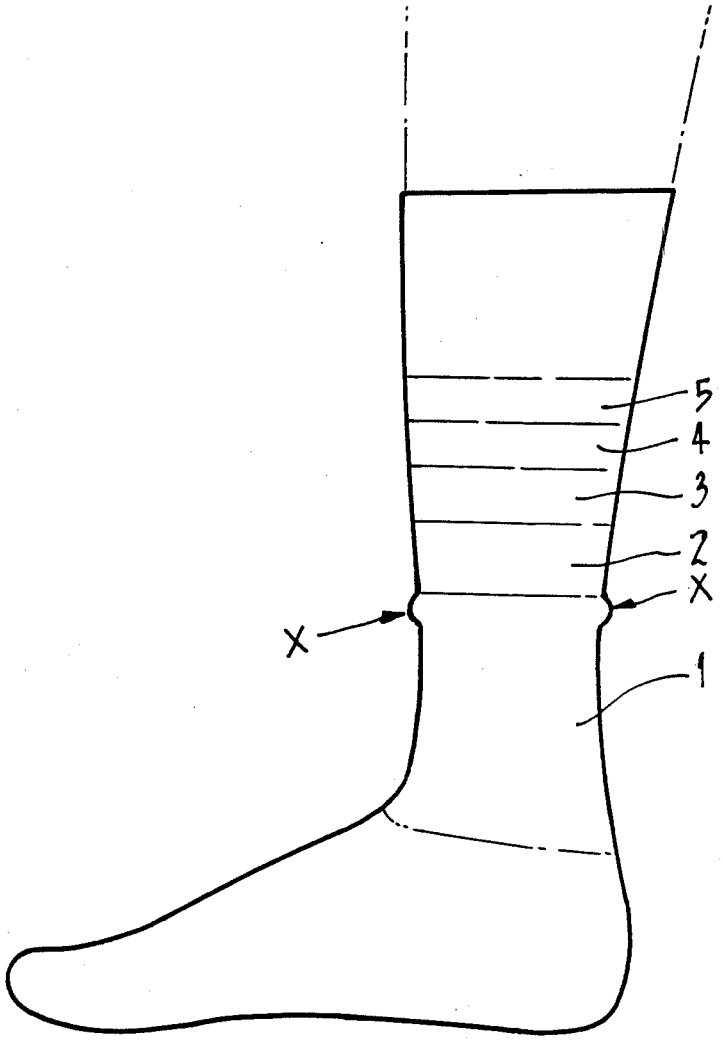
FIG. 4 illustrates a sock with a series of bands of fabric.

The sock shown in FIG. 2 is knitted on a Komet Model TJ2, knitting machine also having a 4 inch diameter cyliner and 176 needles. The sock has in the leg portion between the lines A and F a fabric construction of 1×1 rib type. Characteristics of the fabric in the respective sections of the leg portion of the sock (to fit size range as specified in Example 2), are shown in the following table.

| Leg Portion of sock (FIG. 2) | Yarns | No. of Courses of Knitting | Stitch Size (mm) | No. of courses of Spandex | Length of Spandex (mm) per Course |
|---|---|---|---|---|---|
| A-B | 1/5 tex blend | 4 | — | 3 | 145 |
| B-C | of wood and nylon with a | 36 | 6.5 | 12 | 145 |
| C-D | core of 44 dtex spandex and | 32 | 6.0 | 16 | 145 |
| D-E | 235 dtex spandex double covered with | 116 | 5.9 | 116 | 145 |
| E-F | 44 dtex | 4 | 5.9 | 0 | 0 |

-continued

| Leg Portion of sock (FIG. 2) | Yarns | No. of Courses of Knitting | Stitch Size (mm) | No. of courses of Spandex | Length of Spandex (mm) per Course |
|---|---|---|---|---|---|
| | stretch nylon | | | | |

In this example the required variation in fabric-to-leg pressure is obtained by varying the number of courses of Spandex relative to the total number of courses in the respective sections of the sock.

This sock provides comfortable fit without skin irritation and will resist slipping down the leg of 90% of that population of wearers for which it was designed.

EXAMPLE 3

In this example there is a continuous decrease in fabric tension and fabric-to-leg pressure in a portion of the sock between E (refer FIG. 3) which is approximately the position of minimum leg circumference and D.

This is effected by continuously varying the stitch size of the 1/57 tex yarn and the course length of the 235 dtex double covered spandex. The Knitting Machine in this example is an Esta, Model JU3 with 4 inch cylinder diameter and having 176 needles.

Details of yarn and characteristics of the respective sections of the leg of the sock (fitting men with foot length of 10 to 12 inches inclusive or 25 to 30 cm corresponding to shoe sizes 6 to 10 inclusive) are shown in the following table.

| Leg Portion of sock (FIG. 3) | Yarns | No. of Courses of Knitting | Stitch Size (mm) | No. of courses of Spandex | Length of Spandex (mm) per Course |
|---|---|---|---|---|---|
| A-B | 1/57 tex | 4 | — | — | — |
| B-C | blend of wool and nylon with a core of 44 dtex spandex - | 36 | 6.0 | 0 | — |
| C-D | and | 32 | 7.0 | 16 | — |
| D-E' | 235 dtex | 56 | 7.6 to | 72 | 188 |
| | spandex double | | 6.5 | | 165 |
| E'-E | covered with 44 | 74 | 6.5 | 48 | 165 |
| E-F | dtex stretch nylon | 4 | 6.5 | 0 | — |

This sock provides comfortable fit without skin irritation and will resist slipping down the leg of over 90% of that population of wearers for which it was designed.

In all the above examples, after completion of knitting the toe openings of the socks were closed by seaming. The socks were then scoured at 45° C. in an aqueous medium containing an appropriate detergent, rinsed, dried, placed on metal shapes in an autoclave, subjected to steam for from 40 to 50 seconds at a temperature in the range of 119° C. to 124° C., and excessive moisture removed by convection drying with hot air.

While the foregoing examples and tables have referred to men's socks which by virtue of a "stretch" yarn and/or thread component have fitted a range of foot sizes corresponding to shoe sizes 6 to 10 inclusive, and to socks with legs designed to extend to various points up to the mid-calf in one case and to extend above the mid-calf in another case, the present invention may be employed to provide, additionally, socks of the following types—

Men's socks of any leg length in which one design (or construction) fits only one foot size.

Men's socks designed to fit foot sizes greater than corresponding to shoe size 10 (Australian) or equivalent.

Women's socks of any leg length, foot size and design.

Children's socks of any length, foot size and design.

What we claim is:

1. A knitted man's sock that consists of a knitted leg portion and a knitted foot portion, the knitted leg portion having
   (a) a length which does not extend above the knee of the wearer and
   (b) a leg circumference that increases in an upward direction from a minimum circumference point which when the sock is in use is located below the calf of the wearer, the improvement comprising
   (1) said knitted sock being of a fabric having less than 105 stitches per square centimeter when measured fully stretched in course and wale directions and at standard conditions for testing textiles,
   (2) the fabric-to-leg pressure when the sock is in use progressively decreasing from a point of maximum pressure of 8–16 mm of mercury located on the minimum leg circumference portion of the sock to a point of minimum pressure located adjacent the top marginal portion of the sock, said progressive decrease of pressure being such that the fabric-to-leg pressure at the mid-calf is less than 60% of that at the minimum leg circumference portion and not less than about 2 mm of mercury.

2. A knitted sock as set forth in claim 1 wherein the fabric-to-leg pressure at the mid-calf portion is between about 20% and 40% of the pressure at the minimum leg circumference portion.

3. A knitted sock as set forth in claim 1 wherein the percentage value decrease in the fabric-to-leg pressure at the top marginal portion from the value at the minimum leg circumference is 40% multiplied by the ratio of the distance from the minimum leg circumference to the marginal top of the sock to the distance from the minimum leg circumference to the mid-calf.

4. A knitted sock as set forth in claim 3 wherein the percentage decrease in the fabric-to-leg pressure at the top marginal portion is 80% to 60% multiplied by said ratio.

5. A knitted sock as set forth in claim 1 or claim 3 wherein the decrease in fabric-to-leg pressure is stepwise from said point of minimum circumference to the mid-calf or to the marginal top of the sock.

6. A knitted sock as set forth in claim 1 or claim 3 wherein the fabric-to-leg pressure in the minimum leg circumference portion is in the range of about 8 mm to 16 mm mercury.

7. A knitted sock as set forth in claim 1 or claim 3 wherein the fabric-to-leg pressure in the mid-calf portion is in the range of about 2 mm to 6 mm mercury.

8. A knitted sock as set forth in claim 1 or claim 3 wherein the sock extends above the mid-calf of the leg.

* * * * *